US011724857B2

(12) United States Patent
Chinni Vergotinni

(10) Patent No.: US 11,724,857 B2
(45) Date of Patent: Aug. 15, 2023

(54) MECHANISM FOR JOINING COLLAPSIBLE WALLS OF A PLASTIC CONTAINER

(71) Applicant: WENCO S.A., Santiago (CL)

(72) Inventor: Pedro Chinni Vergotinni, Santiago (CL)

(73) Assignee: Wenco S.A., Santiago (CL)

( * ) Notice: Subject to any disclaimer, the term of this patent is extended or adjusted under 35 U.S.C. 154(b) by 0 days.

(21) Appl. No.: 17/265,426

(22) PCT Filed: Aug. 5, 2019

(86) PCT No.: PCT/CL2019/050067
§ 371 (c)(1),
(2) Date: Feb. 25, 2021

(87) PCT Pub. No.: WO2020/024073
PCT Pub. Date: Feb. 6, 2020

(65) Prior Publication Data

US 2021/0300620 A1 Sep. 30, 2021

(30) Foreign Application Priority Data

Aug. 3, 2018 (CL) ..... 2093-2018

(51) Int. Cl.
*B65D 6/24* (2006.01)

(52) U.S. Cl.
CPC ..... *B65D 11/1873* (2013.01)

(58) Field of Classification Search
CPC ..... B65D 11/1873; B65D 11/1833; B65D 1/1225; B65D 1/225; B65D 7/30; B65D 7/28; B65D 9/22; B65D 11/1893; B65D 11/1866; B65D 11/18; B65D 88/005; B65D 88/528; B65D 90/023
USPC ..... 206/503; 220/4.28, 4.31, 6, 7
See application file for complete search history.

(56) References Cited

U.S. PATENT DOCUMENTS 4,062,467 A * 12/1977 Friedrich ..... B65D 7/26 220/7
4,482,074 A * 11/1984 Lalley ..... B65D 5/005 220/4.28
5,632,392 A * 5/1997 Oh ..... B65D 11/1833 220/6

(Continued)

FOREIGN PATENT DOCUMENTS

AU 2015201265 A1 10/2015
BR PI0008096-9 B1 1/2011

(Continued)

OTHER PUBLICATIONS

Hormazabal Zubicueta, Raul; International Search Report and Written Opinion of the International Searching Authority issued in International Application No. PCT/US2019/050067; 14 pages, including English translation of International Search Report.

*Primary Examiner* — Robert Poon
(74) *Attorney, Agent, or Firm* — Frost Brown Todd LLP

(57) ABSTRACT

An attachment mechanism between folding walls of a plastic container facilitates the assembly and disassembly of said walls and at the same time provides a strong attachment capable of resisting the stresses to which the container is subjected. The attachment mechanism includes a pair of male active closure means, a pair of male passive closure means, a pair of female active closure means and a pair of female passive closure means.

9 Claims, 4 Drawing Sheets

(56) References Cited

U.S. PATENT DOCUMENTS

| | | | | |
|---|---|---|---|---|
| 5,699,926 | A * | 12/1997 | Jacques | B65D 1/243 206/199 |
| 6,918,502 | B1 * | 7/2005 | Overholt | A45C 7/0036 220/6 |
| 7,757,876 | B1 * | 7/2010 | Ditter | A01J 25/15 220/676 |
| 2004/0069780 | A1 | 4/2004 | Apps et al. | |
| 2006/0011627 | A1 | 1/2006 | Overholt et al. | |
| 2007/0017916 | A1 * | 1/2007 | Sabanci | B65D 11/1833 220/7 |
| 2011/0309072 | A1 * | 12/2011 | Rio Gonzalez | B65D 11/1873 219/121.68 |
| 2015/0284135 | A1 * | 10/2015 | Chinni Vergottini | B65D 11/1833 206/503 |

FOREIGN PATENT DOCUMENTS

| | | | |
|---|---|---|---|
| CA | 2316423 | A1 | 5/2001 |
| CA | 2628445 | A1 | 12/2008 |
| CN | 205686754 | U | 11/2016 |
| EP | 2117941 | B1 | 9/2012 |
| KR | 100880911 | B1 | 2/2009 |

* cited by examiner

MECHANISM FOR JOINING COLLAPSIBLE WALLS OF A PLASTIC CONTAINER

FIELD OF THE INVENTION

The present invention has application in the field of folding plastic boxes used for the storage and transport of fruit and vegetable products. In particular, it is related to the connection systems between the walls of said folding boxes in order to obtain more efficient joints.

BACKGROUND OF THE INVENTION

In the packaging and transport industry, specifically during the export of fruit and vegetable products, it is common to use plastic containers of the rectangular or square box type, which are usually built by plastic injection and are formed by a bottom joined to four perimeter walls, wherein said walls are foldable or collapsible with respect to the bottom allowing the containers to be stacked in a disassembled condition and thereby reducing the height of the units during storage thus requiring less space for these purposes in warehouses or storage sites.

An important aspect in folding plastic containers has to do with the attachment mechanism between the walls, since this must be strong enough to prevent it from opening unintentionally as a result of the forces exerted by the products on the internal faces of the container during the transportation and storage. At the same time the attachment mechanism must be lightweight and use an appropriate amount of material that does not lead to an unnecessary increase in container manufacturing costs.

Examples of this type of closing mechanism are disclosed for example in the Patent Registration CL56058 or in the Patent Application CL201702620.

The Patent Registration CL56058 proposes a lightweight joining system made up of a pair of closure means, a male closure means and another female closure means, wherein said closure means join two adjacent walls of a container for horticultural products, preferably the lateral faces as they are fixed to said structures or faces. According to one embodiment, the proposed closure means are of the clip type and comprise active and passive closure means wherein the active closure means comprise clip-type closure means, which engage fixing the closure of the system and the passive closure means engage establishing support points that are not fixed.

On the other hand, the Application CL201702620 proposes improvements to the connection system described above consisting of guides in the form of triangular ribs arranged in the mouth of the passive female closure means, which helps to quickly and unequivocally introduce the passive male closure means into said female closure means.

A drawback detected in the joint systems described above has to do with the difficulty of activating the active closure means to cause the container walls to be disassembled. This difficulty is associated with the fact that the active closure means are of the clip type with a single central male active closure means which must be activated with the thumb of the hand exerting a great pressure force and at the same time sliding it through the female active locking means, an operation that generally causes exhaustion, clamping of the fingers and a great amount of time and attempts to achieve disconnection.

A partial solution to this drawback is proposed in the Patent Application CL 201703173, which discloses a collapsible container with a wall joining system that comprises flexible hooking elements that have hook ends that connect with the respective hook ends of rigid hook elements.

According to the description of said document, by pressing and moving the respective first hook ends closer to each other by the user, said independent hook means are elastically deformed allowing a very easy and quick release.

However, a drawback of the Patent Application CL 201703173 system is that as it does not have passive closure means, which are certainly those that provide resistance to the joint, the only contact surfaces that are generated between the elements that join the container walls correspond to the junction between the ends of the flexible hooking elements with the rigid hooking elements, wherein as it has a flexible component its thickness must be low and it is not capable of resisting the shear force that occurs when the content of the container exerts pressure in a direction perpendicular to the joint between both. Said force will cause the openings of the rigid hooking elements to break the flexible hooking elements causing the container to open undesirably.

Another drawback of the solution proposed in the Patent Application CL 201703173 is that as the hooking elements are located in a cavity at the center of the column of the container walls, the resistance of said column is weakened before axial loads.

It is therefore the objective of the present invention to overcome the drawbacks identified in the state of the art by means of a mechanism for joining the folding walls of a plastic container that facilitates the assembly and disassembly of said walls and that at the same time provides a strong attachment capable of resisting the stresses to which the container is subjected without the incorporation of elements or material that increases its final weight.

DESCRIPTION OF THE INVENTION

The present invention consists of an attachment mechanism between folding walls of a plastic container which comprises male closure means located at one end of a container wall and female closure means located at one end of the adjacent wall of the container, wherein said male closure means consist of a pair of male active closure means and a pair of male passive closure means and wherein said female closure means consist of a pair of female active closure means and a pair of female passive closure means.

According to a preferred embodiment of the invention, the male passive closure means are arranged contiguously in the vertical direction of the end of the container wall configuring an upper male passive closure means and a lower passive closure means. In this arrangement each male active closure means is arranged respectively above the upper male passive closure means and under the lower male passive closure means.

This configuration advantageously allows the hooking elements, that is to say, the male active closure means to be well spaced in the vertical sense from the ends of the container wall causing a stronger attachment between walls than the systems of the state of the art with a single hooking element, which tends to pivot with respect to the attachment between the bottom and the folding walls of the container.

According to a preferred embodiment of the invention, the male active closure means consist of projections that have a protrusion at their end and that slide inside the female active closure means. Advantageously, this configuration allows the simultaneous disengagement of the male active closure means with the index and thumb fingers of a single hand due to the fact that the protrusions are accessible and are oriented opposite each other.

Along with the above, at least one male active closure means comprises an additional support element. Preferably, said additional support element is configured in the upper male active closure means because it is the one that is farthest from the articulation of the wall with the bottom of the container and therefore is more stressed. In this way the combined tensile and bending stresses acting on the stem of the upper male active closure means are reduced.

These and other advantages will be more easily appreciated from the Figures described below.

DETAILED DESCRIPTION OF THE FIGURES

Figure 1:
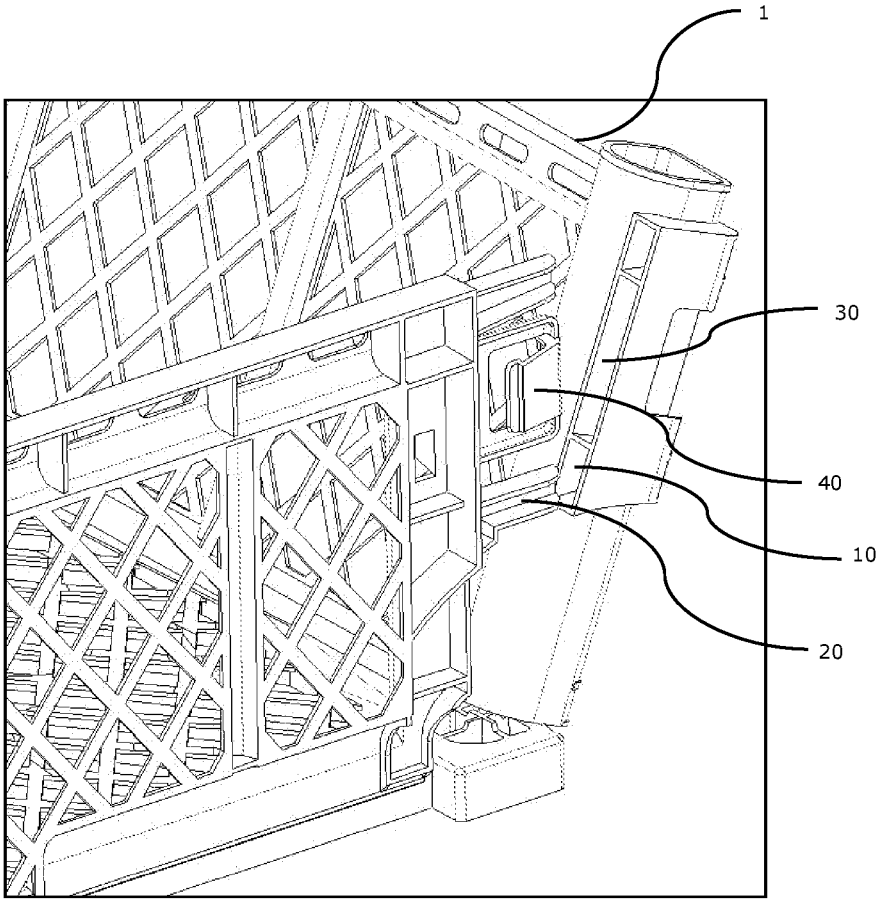
PRIOR ART Fig. 1
FIG. 1 illustrates an attachment mechanism of folding walls of the state of the art.

For reference purposes, FIG. 1 illustrates an attachment mechanism disclosed in the state of the art and discussed in the background section of the invention, which is located at the ends of the folding walls of a container 1. The attachment mechanism consists of active closure means, in particular a female active closure means 10 that engages with a male active closure means 20 and with passive closure means, in particular with a pair of female passive closure means 30 that respectively engage in a pair of male passive closure means 40.

The connection operation of the mechanism illustrated in FIG. 1 therefore consists of inserting the male passive closure means 20 into the female passive closure means 10 and inserting the sliding the male active closure means 40 into the female active closure means 300 until the rear face of the flange that has the first one engages with the rear edge of the second one.

Figure 2:
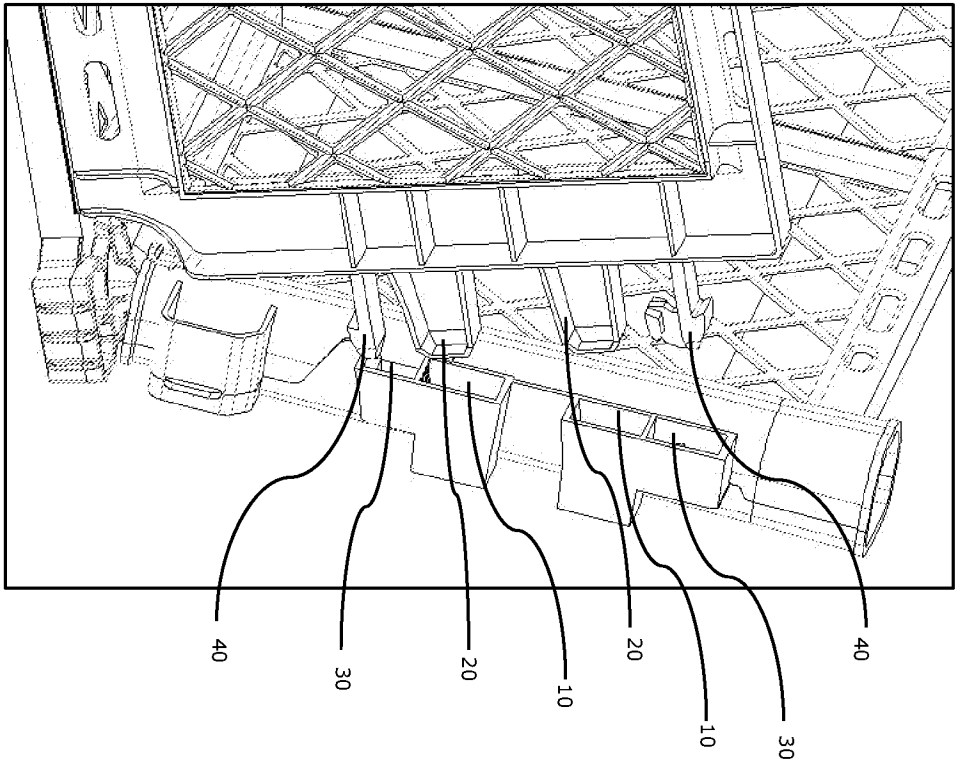
FIG. 2 illustrates the attachment mechanism of the present invention in the deactivated mode.

According to FIG. 2, an improved attachment mechanism is proposed in which there are two vertically contiguous male passive closure means 20 arising from the end of a container wall 1. Above the upper male passive closure means 20 and under the lower male passive closure means 20 a male active closure means 40 is respectively provided.

On the other hand, at the end of the opposite wall of the container there is at least one female closure means which in the illustrated embodiment comprises two parts, an upper part and a lower part, each one comprising a female passive closure means 10 and a female active closure means 30 shaped like channels and configured to connect with a respective male passive closure means 20 and a male active closure means 40. According to alternative embodiments, the female closure means may be a single piece comprising the four female closure means (active and passive).

According to the illustrated preferred embodiment, the female closure means are located at the end of a container wall preferably adhered to a hollow column located at said end of the wall. The fact that the female closure means are at the end of the wall and not inserted in the structure of the wall or column, advantageously prevents it from being weakened by axial loads, for example, those caused by the stacking of containers where these loads must be absorbed to a large extent by the columns of the containers walls for proper operation.

Figure 3:
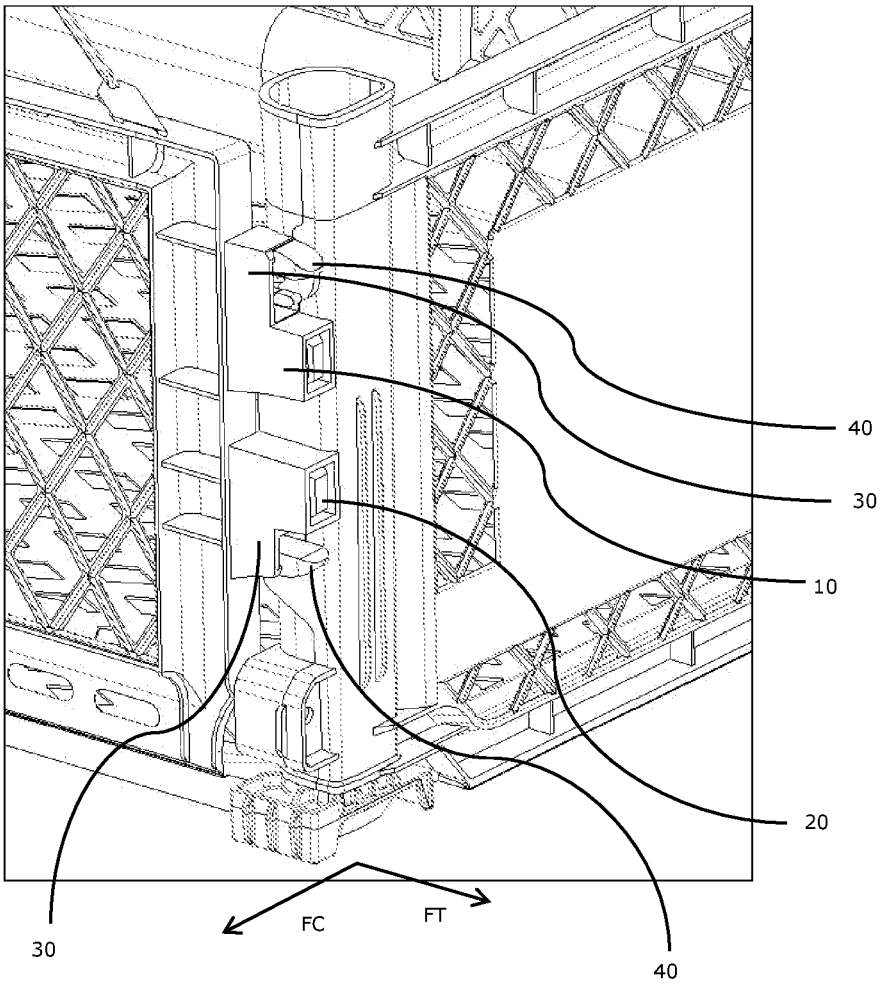
FIG. 3 illustrates the attachment mechanism of the present invention in the activated mode.

FIG. 3 illustrates the embodiment of the attachment mechanism in its assembled mode where it is possible to appreciate that the male passive closure means 20 are completely inserted in the female passive closure means 10. In this way, a very robust connection is provided to the shear forces (SF) that are generated on the joint when the products inside the container exert pressure on the wall that has the male passive closure means 20. That is why preferably said wall corresponds to the longest wall of the container, that is, the one that is subject to greater pressure from said products.

On the other hand, the male active closure means 40 remain firmly attached to the female active closure means 30, resisting the traction forces (TF) exerted by the products of the container on the shorter walls of the container which are those preferably comprising the female closure means (10, 30).

Figure 4:
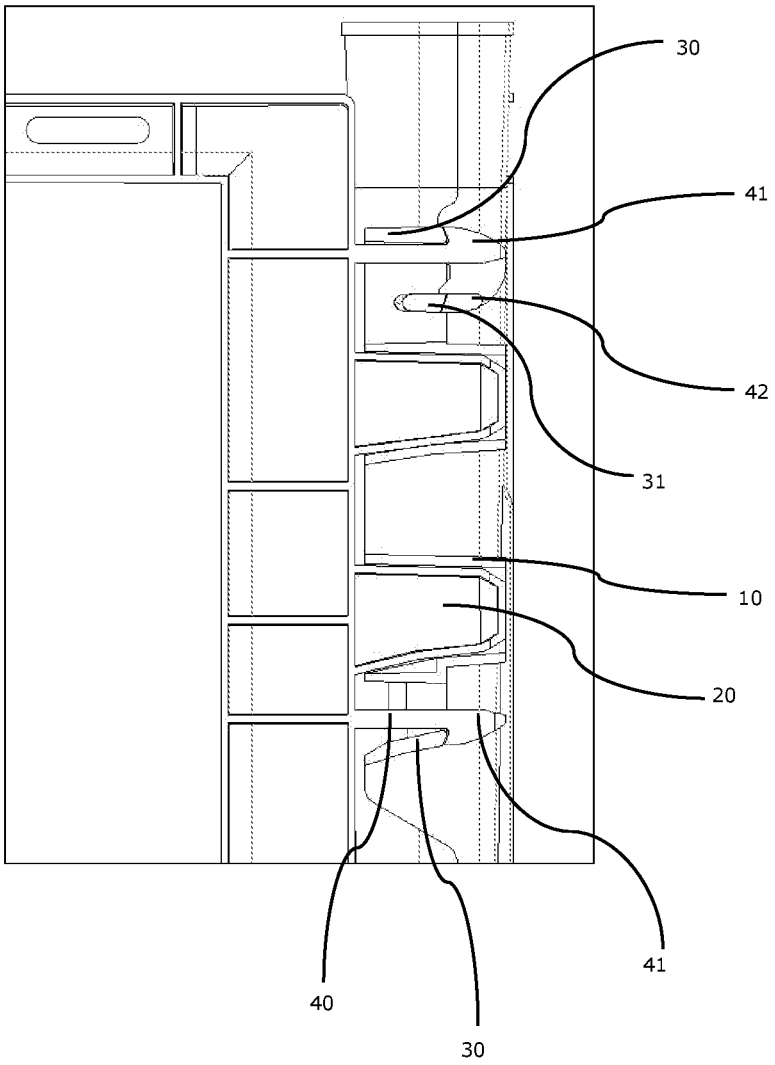
FIG. 4 illustrates a sectional view of the attachment mechanism of the present invention in the activated mode.

FIG. 4 illustrates in more detail the shape of the male closure means in where it is appreciated that the male passive closure means 20 consist of grooved projections whose lower face is slightly inclined. This inclination helps to guide and favor the connection with the female passive closure means 10.

On the other hand, the male active closure means 40 consist of thinner projections that have a protrusion 41 at their end in the form of a hook-like lock, that is, it allows the body to pass through the channel of the female active closure means 30 but in its final position it prevents the natural return through said channel because its rear face has an opening that engages in one of the edges of the female active closure means 30. According to the illustrated preferred embodiment, the protuberance 41 of the upper male active closure means 40 engages the upper edge of the upper female active closure means 30 while the protrusion 41 of the lower male active closure means 40 engages the lower edge of the lower female active closure means 30.

Additionally and according to the preferred embodiment illustrated in FIG. 4, the upper male active closure means 40 comprises an additional support element 42 configured to engage in a stop 31 configured inside the upper female active closure means 30. Said additional support element 42 preferably consists of a projection located under the protuberance 41.

In this way, the method of disassembling the proposed attachment mechanism consists of pressing together the protrusions 41 of both male active closure means 40 causing their insertion into the channel of the respective female passive closure means 30 and at the same time causing displacement of the additional support element 42 with respect to the stop 31 thus being able to slide the male closure means (40, 20) through the female closure means (30, 10).

The invention claimed is:

1. A plastic collapsible container having folding walls and comprising an attachment mechanism between two adjacent folding walls thereof, said attachment mechanism comprising four male projections located at one end of a first folding wall of the container and arranged in a vertical direction, and four female channels located at one end of a second folding wall adjacent to the first folding wall of the container and arranged in a vertical direction, wherein said male projections comprise a pair of flexible male active projections and a pair of rigid male passive projections, and said female channels comprise a pair of female active channels configured to receive the pair of flexible male active projections and a pair of female passive channels configured to receive the pair of rigid male passive projections, wherein one of the pair of flexible male active projections is arranged above one of the pair of rigid male passive projections, and wherein the other one of the pair of flexible male active projections is arranged under the other of the pair of rigid male passive projections, wherein each one of the pair of rigid male passive projections comprises a respective inclined lower face, and wherein each one of the pair of flexible male active projections comprises a respective protrusion at its end, the respective protrusions being oriented opposite each other and each being configured to slide inside a respective one of the pair of female active channels.

2. The container according to claim 1, wherein one of said protrusions has the shape of a hook-type lock.

3. The container according to claim 2, wherein one of said pair of flexible male active projections comprises an additional support element.

4. The container according to claim 3, wherein the additional support element comprises a projection located under the one of said protrusions.

5. The container according to claim 1, wherein each of the pair of rigid male passive projections comprises a respective grooved projection.

6. The container according to claim 1, wherein each of the four female channels comprises an upper edge and a lower edge.

7. The container according to claim 1, wherein at least one of the pair of female active channels comprises a stop configured inside it.

8. The container according to claim 1, wherein the four female channels are separated into two parts, namely an upper part and a lower part.

9. The container according to claim 1, wherein a first set of the four female channels is attached to a hollow column located at an end of one of the folding walls of the container; and a second set of the four female channels is attached to a hollow column located at an end of another of the folding walls of the container.

* * * * *